US005872499A

United States Patent [19]

Poulsen

[11] Patent Number: 5,872,499

[45] Date of Patent: Feb. 16, 1999

[54] CURRENT SENSING RELAY

[76] Inventor: Peder U. Poulsen, Huntington Rd., Box 197, Stratford, Conn. 06497

[21] Appl. No.: 946,369

[22] Filed: Oct. 7, 1997

Related U.S. Application Data

[63] Continuation-in-part of Ser. No. 661,216, Jun. 10, 1996, Pat. No. 5,701,109, which is a continuation-in-part of Ser. No. 348,405, Dec. 2, 1994, Pat. No. 5,525,948.

[60] Provisional application No. 60/000,523 Jun. 30, 1995.

[51] Int. Cl. [6] ..... H01H 9/00

[52] U.S. Cl. ..... 335/177; 335/178

[58] Field of Search ..... 335/78–86, 124, 335/128, 177–179, 182; 361/139, 143, 160, 166

[56] References Cited

U.S. PATENT DOCUMENTS

| | | | |
|---|---|---|---|
| 5,363,270 | 11/1994 | Wabba | 335/177 |
| 5,525,948 | 6/1996 | Poulsen | 335/78 |
| 5,701,109 | 12/1997 | Poulsen | 335/78 |

*Primary Examiner*—Lincoln Donovan

*Attorney, Agent, or Firm*—John H. Crozier

[57] ABSTRACT

An electromagnetic relay, having ON and OFF states, for connecting a source of electrical current to a load, said relay comprising: an armature movable between ON and OFF positions corresponding, respectively, to said ON and OFF states of said relay; a magnetic core surrounded by first windings forming a holding coil to magnetize said core when a first portion of electrical current is passed through said holding coil and consequently to cause said armature to move from said OFF position to said ON position as a result of a magnetic attraction produced between said magnetic core and said armature, resulting in causing a second portion of electrical current to flow through said load; said magnetic core additionally surrounded by second windings forming a load coil through which said second portion of said electrical current flows when said armature is in said ON position, said load coil producing a magnetic field which counteracts a magnetic field produced by said holding coil; and parameters of said load coil being selected such that, when said second portion of said electrical current reaches a predetermined level, a resulting loss in magnetic attraction between said armature and said magnetic core will cause said armature to be released, interrupting flow of said electrical current through said holding coil, and causing said relay to switch from said ON state to said OFF state.

3 Claims, 1 Drawing Sheet

CURRENT SENSING RELAY

CROSS-REFERENCE TO RELATED APPLICATIONS

Benefit is claimed of US provisional application No. 60/000,523, filed Jun. 30, 1995. The present application is a continuation-in-part of application Ser. No. 08/661,216, filed Jun. 10, 1996, and titled CURRENT SENSING RELAY, now U.S. Pat. No. 5,701,109, issued Dec. 23, 1997, which is a continuation-in-part of application Ser. No. 08/348,405, filed Dec. 2, 1994, and titled MANUALLY OPERATED, ELECTROMAGNETICALLY RESETTABLE SAFETY SWITCH, now U.S. Pat. No. 5,525,948, issued Jun. 11, 1996, the disclosures of which applications are incorporated by reference hereinto.

BACKGROUND OF THE INVENTION

1. Field of the Invention

The present invention relates to relays generally and, more particularly, but not by way of limitation, to a novel current sensing electromagnetic relay of simple construction.

2. Background Art

Electromagnetic relays are often used for controlling motors and processes in conjunction with a so called "holding circuit" which utilizes one set of the relay's normally open contacts. The objective of the holding circuit is to keep the relay closed after the cessation of a start pulse, for example after a start push-button has been released. The holding circuit incorporates one or several sets of normally closed contacts connected in series. One of these contacts may be operated by a stop push-button, while another may be a timer, a counter, or a limit switch, serving to stop the process at will or automatically, after a work cycle has been completed.

In addition to the functions mentioned above, holding circuits often incorporate current sensors which will stop the motor or process in case of a short circuit or overload, and such current sensors usually utilize contacts operated by separate, magnetic, or thermally operated circuit breaker mechanisms.

Accordingly, it is a principal object of the present invention to provide a current sensing relay which incorporates a holding circuit and which does not require separate thermally or magnetically operated contacts to open the holding circuit.

It is a further object of the invention to provide such a relay that is simply and economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an electromagnetic relay, having ON and OFF states, for connecting a source of electrical current to a load, said relay comprising: an armature movable between ON and OFF positions corresponding, respectively, to said ON and OFF states of said relay; a magnetic core surrounded by first windings forming a holding coil to magnetize said core when a first portion of electrical current is passed through said holding coil and consequently to cause said armature to move from said OFF position to said ON position as a result of a magnetic attraction produced between said magnetic core and said armature, resulting in causing a second portion of electrical current to flow through said load; said magnetic core additionally surrounded by second windings forming a load coil through which said second portion of said electrical current flows when said armature is in said ON position, said load coil producing a magnetic field which counteracts a magnetic field produced by said holding coil; and parameters of said load coil being selected such that, when said second portion of said electrical current reaches a predetermined level, a resulting loss in magnetic attraction between said armature and said magnetic core will cause said armature to be released, interrupting flow of said electrical current through said holding coil, and causing said relay to switch from said ON state to said OFF state.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
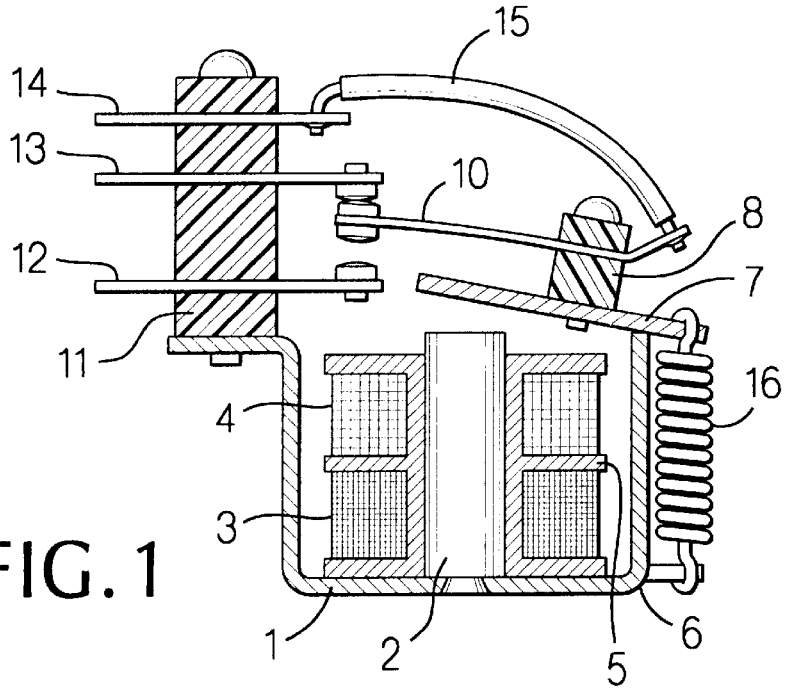
FIG. 1 is a sectional, elevational view through a preferred embodiment of a relay according to the invention.

Reference should now be made to the drawing figures, on which similar or identical elements are given consistent identifying numerals throughout the various figures, and on which parenthetical references to figure numbers direct the reader to the view(s) on which the element(s) being described is (are) best seen, although the element(s) may be seen also on other views.

Referring now to FIGS. 1, a substantially U-shaped, magnetizable frame 1 is provided with a magnetizable core 2, which is surrounded by windings 3 and 4 wound onto a dual chamber bobbin 5. The core is approximately as long as the leg 6 of frame 1, the frame and core comprising together a soft magnetic circuit which may be energized by means of electric current flowing in windings 3 or 4. Pivotally supported adjacent the free end of leg 6 is an armature 7 which extends over the free end of core 2. Extended from one side of the armature 7 is an insulating block 8, upon which is mounted at least two springs 10 (only one spring is visible in the sectional view of FIG. 1), each spring is provided with a contact mounted near its end. Another insulting block 11 is mounted onto the opposite leg of frame 1, supporting at least two each of contact carrying springs 12 and 13 plus a similar number of shorter lugs 14, each connected with a spring 10 via a flexible lead 15. A coil spring 16, mounted between the armature and the stationary frame 1, seeks to keep the magnetic circuit and contacts 10 and 12 open until the relay is energized.

It will be obvious to persons skilled in the art that the structure described above is very similar to a common embodiment of an electromagnetic relay, the main difference being the two-chamber bobbin 5 with its individual windings 3 and 4. Its function will be described in the following with reference to the circuit diagram shown on FIG. 2.

Figure 2:
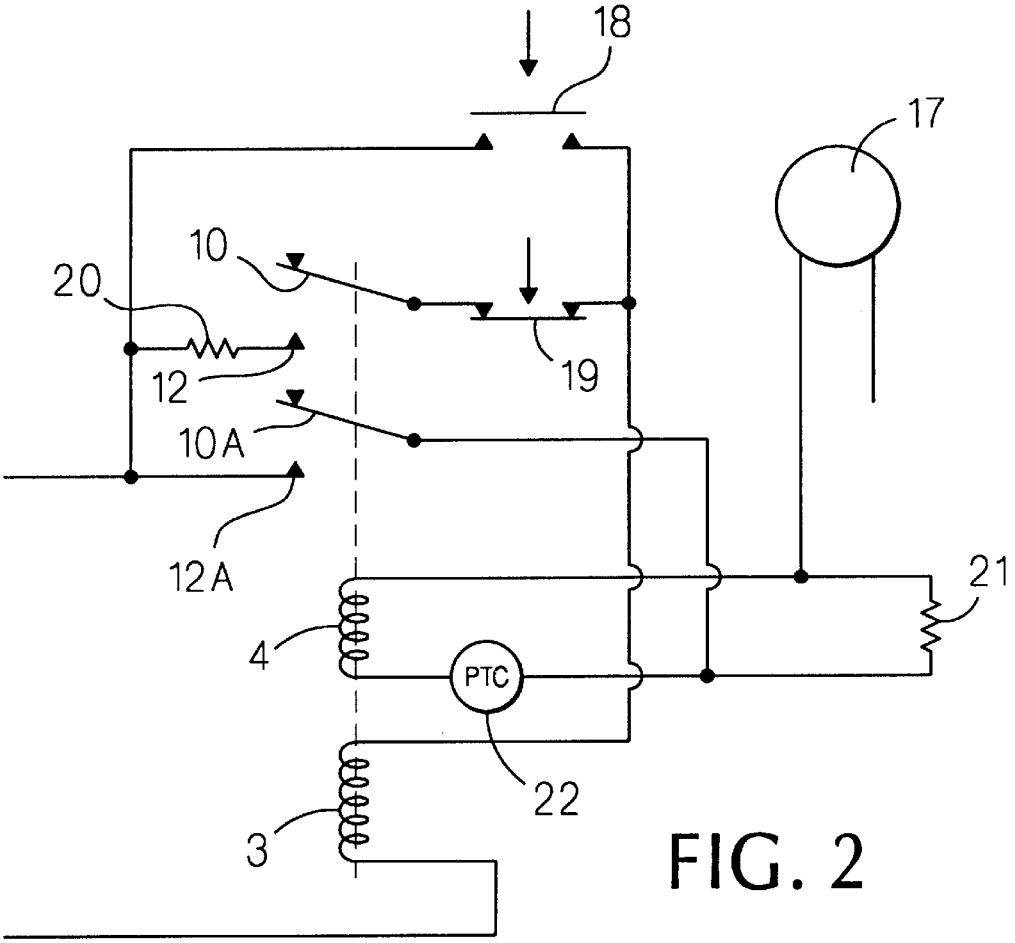
FIG. 2 is a circuit diagram illustrating the function of the relay.

The diagram on FIG. 2 shows a relay according to the invention being used to control a load 17 via the normally open contact set 10A and 12A and series coil 4. The process is started by closing a momentary ON push-button switch 18 to energize coil 3, which will attract the armature 7, thereby closing main contacts 10A and 12A and auxiliary contacts 10 and 12. At this point, current will continue to flow through coil 3 via contacts 10 and 12, and the relay will remain closed, and the process continues until one the following occurrences:

1. The operator engages the normally closed OFF push-button switch in the holding circuit, cutting off current to coil 3.

2. In case of a power failure, the relay will open and remain open, even after power is re-instated.

3. In case of overload, which causes the load current passing through coil 4 to rise beyond a predetermined limit. Since coil 4 is wound and oriented to produce a magnetic field counteracting that of coil 3, as the load current increases, eventually the force of coil spring 16 (FIG. 1) will overcome the remaining magnetic attraction and cause the relay to open. The number of ampere turns in coil 4 required to trip the relay depends on the level of the current flowing in coil 3, and since only a fraction of the power required to close the relay is required to hold it closed, according to the invention the sensitivity of the system may be increased by adding a current limiting means, in this case a resistor 20, to the holding circuit. The value of the resistor and the impedance in the coil can be selected to provide just enough attraction to hold the relay closed, meaning that a minimal current flowing in coil 4 is sufficient to trip the system. Because of the modest power requirement, a fixed resistor or potentiometer dimensioned to dissipate a watt or less is sufficient for adjusting the trip point within wide limits. The range can be increased by changing the wire gauge or adjusting the number of turns in coil 4, or, after selecting the optimum combination, by means of a shunt resistor 21, inserted in parallel with coil 4. If a shunt resistor is used to carry the majority of the load current, also in accordance with the invention, a delay action can be selected by inserting a so called NTC resistor 22 in series with coil 4. In case of an overload, the resistance will be high at first, holding the trip current down, but after a few seconds dependent on the component parameters, the NTC resistor will heat up, and its resistance will drop to increase the trip current until the relay opens.

While a particular embodiment of a device according to the invention has been shown and described in the above, it is understood that many variations are possible within the general scope and spirit of the invention. Examples of obvious variations would be modifications to the magnetic circuit including for example straight moving, unhinged versions, and variations in the number and configuration of the contact sets in order to meet specific requirements. Another obvious variation would be adapting a relay according to the invention as a remote reset ground fault current interrupter.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An electromagnetic relay, having ON and OFF states, for connecting a source of electrical current to a load, said relay comprising:

(a) an armature movable between ON and OFF positions corresponding, respectively, to said ON and OFF states of said relay;

(b) a magnetic core surrounded by first windings forming a holding coil to magnetize said core when a first portion of electrical current is passed through said holding coil and consequently to cause said armature to move from said OFF position to said ON position as a result of a magnetic attraction produced between said magnetic core and said armature, resulting in causing a second portion of electrical current to flow through said load;

(c) said magnetic core additionally surrounded by second windings forming a load coil through which said second portion of said electrical current flows when said armature is in said ON position, said load coil producing a magnetic field which counteracts a magnetic field produced by said holding coil; and (d) parameters of said load coil being selected such that, when said second portion of said electrical current reaches a predetermined level, a resulting loss in magnetic attraction between said armature and said magnetic core will cause said armature to be released, interrupting flow of said electrical current through said holding coil, and causing said relay to switch from said ON state to said OFF state.

2. An electromagnetic relay, as defined in claim 1, further comprising: attenuation means disposed in series with said holding coil, serving to pre-select strength of said magnetic field produced by said holding coil.

3. An electromagnetic relay, as defined in claim 1, further comprising:

(a) a negative temperature coefficient resistor disposed in series with said load coil;

(b) a shunt resistor disposed in parallel with said load coil and said negative temperature coefficient resistor; and (c) said shunt resistor being selected to carry a main part of said second portion of electrical current, presence of said negative temperature coefficient resistor resulting in a delayed action due to gradual rise of said second portion of electrical current through said load coil as temperature of said negative temperature coefficient resistor rises, until said magnetic field produced by said load coil increases sufficiently to cause said relay to switch from said ON state to said OFF state.

* * * * *